US005616020A

United States Patent [19]

Firestone

[11] Patent Number: 5,616,020

[45] Date of Patent: Apr. 1, 1997

[54] ROTARY VANE PUMP

[75] Inventor: Douglas B. Firestone, Santee, Calif.

[73] Assignee: Quik Pump, Inc., Santee, Calif.

[21] Appl. No.: 430,149

[22] Filed: Apr. 26, 1995

Related U.S. Application Data

[63] Continuation-in-part of Ser. No. 309,791, Sep. 21, 1994, abandoned, which is a continuation-in-part of Ser. No. 104,341, Aug. 9, 1993, abandoned.

[51] Int. Cl.[6] ..... F01C 19/02

[52] U.S. Cl. ..... 418/138

[58] Field of Search ..... 418/138, 189, 418/235, 241, 265

[56] References Cited

U.S. PATENT DOCUMENTS

| | | | |
|---|---|---|---|
| 1,012,155 | 12/1911 | Ragsdale | 418/138 |
| 1,270,522 | 6/1918 | Jacobsen | 418/138 |
| 1,385,880 | 7/1921 | Master | 418/138 |
| 1,736,105 | 11/1929 | Washington | 418/138 |
| 2,243,898 | 6/1941 | Fulcher | 418/138 |
| 2,778,317 | 1/1957 | Cockburn | 418/189 |
| 4,024,840 | 5/1977 | Christy | 418/138 |
| 4,678,413 | 7/1987 | Ries | 418/138 |

FOREIGN PATENT DOCUMENTS

| | | | |
|---|---|---|---|
| 0885605 | 9/1943 | France | 418/138 |
| 2240519 | 3/1974 | Germany | 918/138 |

*Primary Examiner*—Richard A. Bertsch
*Assistant Examiner*—Charles G. Freay

[57] ABSTRACT

A rotary vane pump comprising a housing having an inner cam surface defining a chamber and an inlet and an outlet port establishing fluid communication. A plurality of vanes are arranged substantially radially about a central vane axis of rotation. A rotatable carousel rotor is positioned on a drive axis displaced a predetermined distance from the central vane axis. The carousel has slot members positioned in it for reciprocally carrying each vane during the rotation of the vane. A one-piece central rotor gear is rotatably mounted on the central axis for pivotally coupling each vane at a point offset from the vane axis to establish rocking lever action between the carousel and the vanes upon rotation of the vanes.

9 Claims, 4 Drawing Sheets

10
12
14
16
18
20
22
24
26
4
a
b
34
56
57
58
59
61
89
116
112
126
74
88
60
30
38
100
1102
v
h

ROTARY VANE PUMP

This application is a continuation-in-part of application Ser. No. 08/309,791, filed Sep. 21, 1994, which is a continuation-in-part of application Ser. No. 08/104,341, filed, now abandoned.

FIELD OF THE INVENTION

This invention relates generally to pumps. More specifically, the invention relates to rotary vane pumps for moving volumes of liquids. The present invention is particulary, though not exclusively, useful for pumping sizeable volumes of liquid in a relatively short time with relative ease, such as by hand power.

BACKGROUND OF THE INVENTION

Various types of pumps have been available for many, many years. One type of pump that has been in use is a rotary vane pump. A rotary vane pump uses moveable sealing elements, or vanes, in the form of rigid blades, rollers, slippers, shoes, buckets, and the like. The vanes are moved in a generally circular motion, in conjunction with movement radially inward and outward by cam surfaces to maintain a fluid seal in the pump housing, between the input and output ports of the pump, during operation of the pump.

In the past, there have been several rotary vane pumps disclosed in the prior art, including those disclosed in U.S. Pat. No. 4,011,033; 4,061,450; 4,019,840; and 4,073,608 to Christy for positive displacement vane-type rotary pumps, incorporated herein by reference. These prior art pumps have vane members which extend radially outwardly from and are connected to a rotor mechanism so that upon rotation of the rotor the vanes move a uniform distance through an arc to pump fluid in the pumping channel from the inlet port to the outlet port.

A disadvantage of these prior art devices is that they have not been the most efficient form of pump. In addition, such prior art pumps have been known to wear out and have components that break, and thus need replacement after a limited amount of use. Also such pumps are not efficient to manufacture.

Accordingly, it is an object of the present invention to provide a rotary vane pump which effectively increases the flow of fluid through the pump. It is yet another object of the present invention to provide a rotary vane pump which is durable and reliable in operation. Another object of the present invention is to provide a rotary vane pump which is efficient in its use, yet cost effective in its manufacture. This and other objects of the present invention will become apparent in the further description of the invention herein contained,

SUMMARY OF THE INVENTION

A preferred embodiment of the rotary vane pump comprises a housing having a front cover and a rear cover, and an inner surface defining a chamber. The housing has an inlet and an outlet for establishing fluid communication with the chamber. Within the chamber there are a plurality of vanes arranged substantially radially about a central or vane axis of rotation. Each vane has an outside edge for following the inner surface of the chamber to define the path of rotation of the vanes. Movement of the vanes is driven by a rotatable carousel rotor, which is positioned in the chamber with its drive axis of rotation being displaced a predetermined distance from the central axis. The carousel carries spaced slotted members in it into which each vane is placed for reciprocally carrying each vane during rotation of the carousel rotors. A central rotor gear member is freely rotatably mounted on the central axis in the housing for guiding rotation of the vanes. The rotor mechanism comprises a one-piece member to which each vane is pivotally coupled at a point offset from the drive axis of the carousel rotor to establish a rocking lever action between the carousel and the vanes upon rotation of the rotor. The vanes are carried in the carousel so that pairs of vanes move through a first position situated on a line offset from the vane axis of rotation, and through a perpendicular position situated on a line which passes through the vane axis. In a preferred embodiment, the rotor mechanism is a spider gear, and each vane has a cylindrical pivot portion along its proximal edge that pivotally rides in equally spaced grooves of the spider gear. The inside surface of the front cover has an outer circular raised portion and a central circular raised portion forming a circular groove which guides the carousel when it rotates. The circular raised portion includes a first pair of wedge-shaped inclined fluid escape channels formed therein, and the central raised portion includes a smaller pair of similarly-shaped fluid escape channels. The inside surface of the back cover includes a pair of similarly shaped corresponding fluid escape channels positioned opposite the first pair of channels. The fluid escape channels direct the fluid in a manner to prevent unwanted pressure build-up behind the vanes in the upper portion of the pump.

The novel features of this invention, as well as the invention itself, both as to its structure and to its operation, will be best understood from the accompanying drawings taking in conjunction with the accompanying description, in which similar reference characters refer to similar parts.

DESCRIPTION OF THE PREFERRED EMBODIMENT

Figures 1, 4:
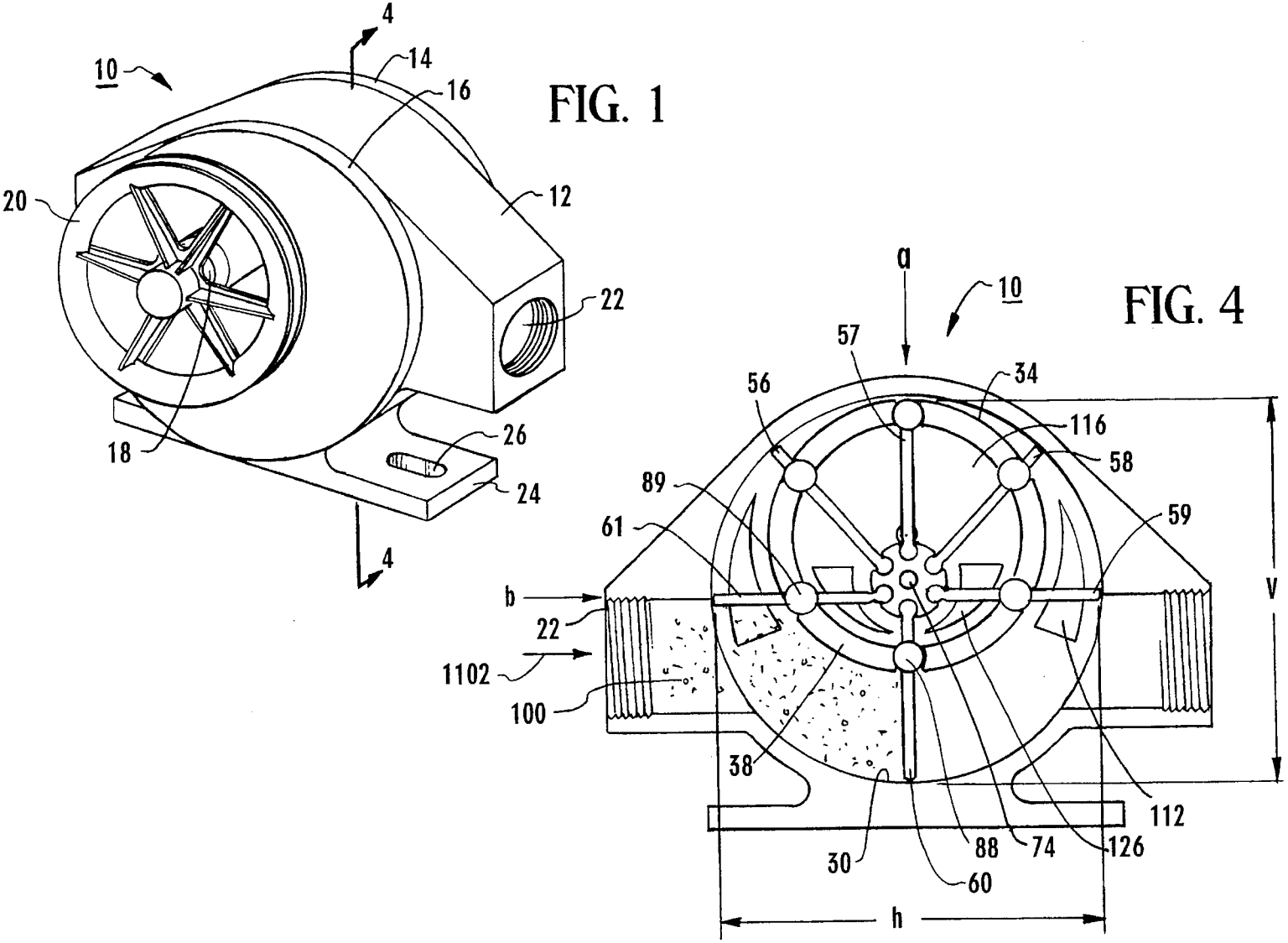
FIG. 1 is a perspective view of a rotary vane pump in accordance with the present invention.
FIG. 4 is a vertical diagrammatic sectional view taken along line 4—4 in FIG. 1 illustrating an input phase of operation of the pump.

In FIG. 1 there is shown a perspective view of a rotary vane pump apparatus in accordance with the present invention, generally designated as 10. Pump 10 comprises a housing 12 having a front cover 14 and rear cover 16 connected thereto. Rotatably mounted in the housing is a drive shaft 18 connected to a drive hub 20. In the embodiment shown, drive hub 20 includes a pulley for attachment to a belt. It is contemplated, however, that drive hub 20 could also comprise a crank for hand cranking due to the efficiency of operation of the pump as herein described. On opposite ends of housing 12 are inlet and/or outlet ports 22, one of which can be seen in FIG. 1, for movement of fluid into and out of the pump 10.

In the embodiment shown, housing 12 includes a base portion 24 having mounting holes 26 for connecting the pump 10 in a fixed position depending on the application needed. In the embodiment shown, the material to be utilized for the pump to realize major benefits of its operation, are 6/6 nylon material with Kevlar (trademark) which provides rigidity of the pump as well as self lubrication and resistance to changes due to chemical substances and temperatures. The housing and other components as described herein can also be made of this or similar materials which can be chosen depending on the particular application of liquid to be pumped.

Figure 2:
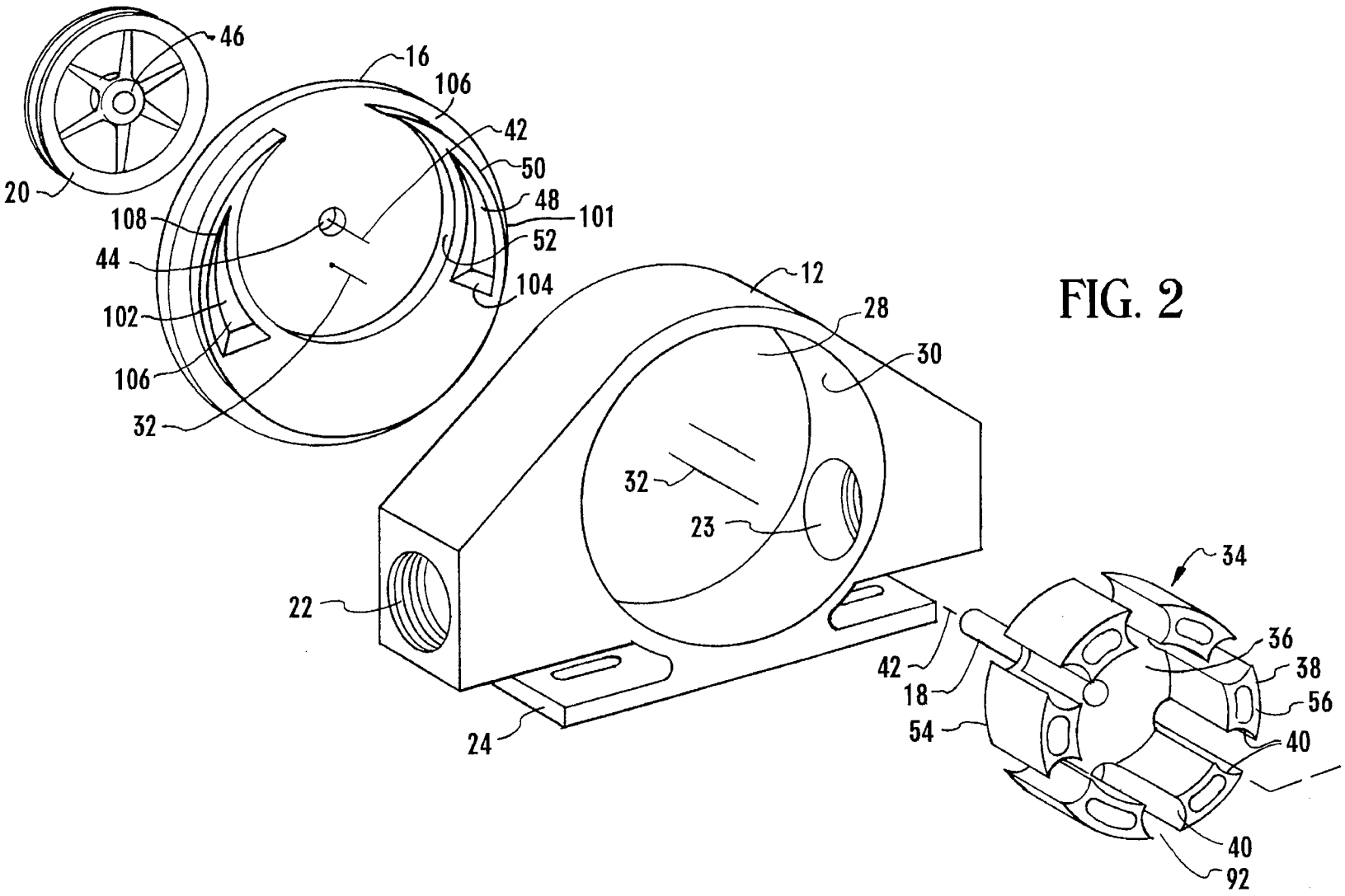
FIG. 2 is an exploded view in perspective showing certain components of the pump shown in FIG. 1.
Figure 3:
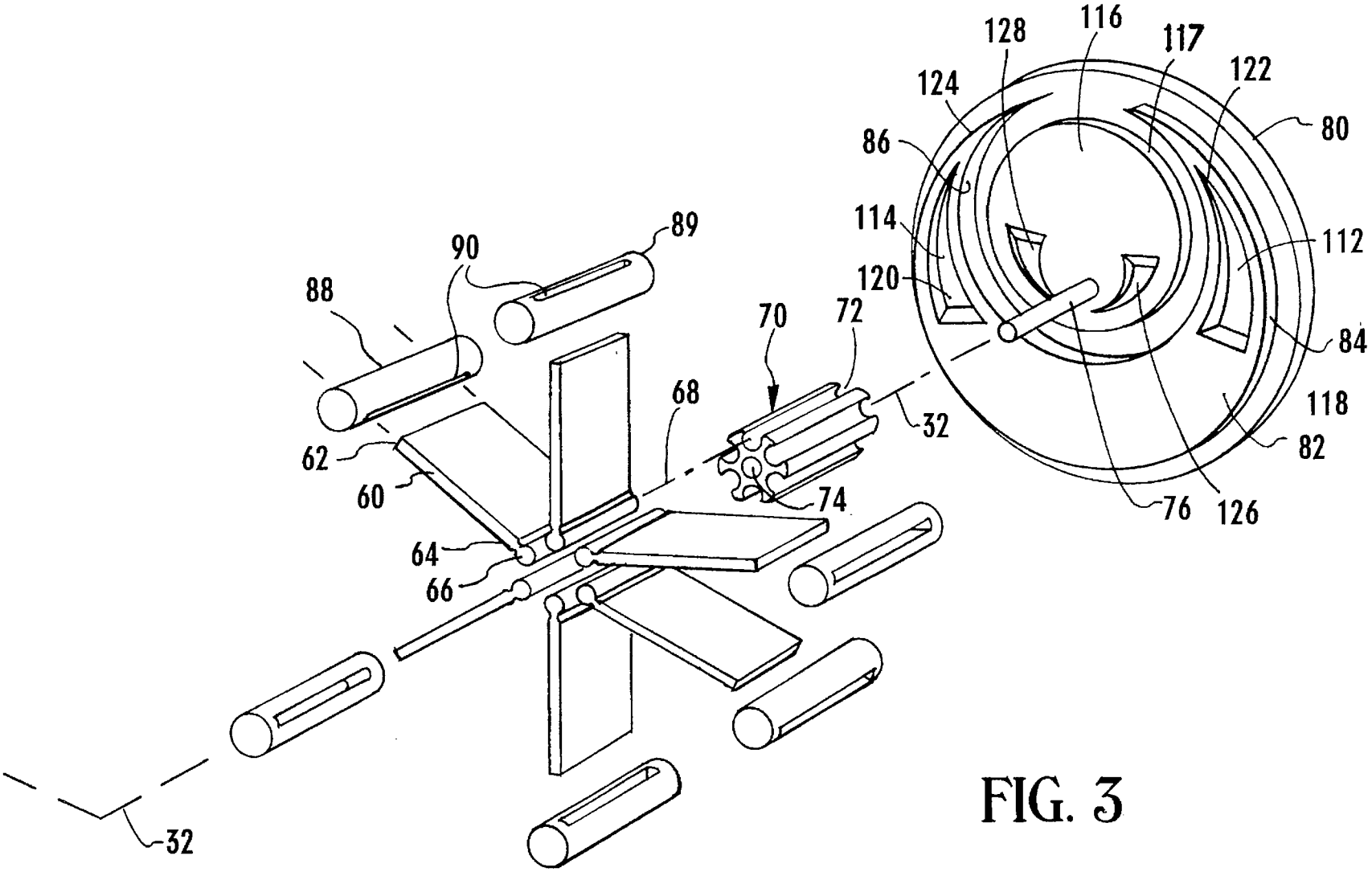
FIG. 3 is an exploded view in perspective of remaining components of the pump shown in FIG. 1.

Referring now to FIGS. 2 and 3, there is shown in more detail the components of the pump 10 shown in FIG. 1. In particular, housing 12 has a hollow chamber 28 defined by an inner cam surface 30. In the embodiment shown, cam surface 30 is essentially a cylindrical shape having a circle as a cross-section as shown in the drawings. However, this shape can be varied into an elliptical shape depending on the construction of the components of the pump as further described herein. Ports 22 and 23 are located opposite one another in a lower portion of inner cam surface 30 to provide fluid communication between the outside of housing 12 and the inside chamber 28. In the embodiment shown, inlet port and outlet ports 22, 23 are threaded as shown to allow an input line and an output line to be connected to the pump as may be required for the particular application. The inner cam surface 30 of chamber 28 is concentric about a central axis 32.

As further shown in FIG. 2, drive shaft 18 is connected to a generally cylindrical drive rotor carousel 34. Carousel 34 has extending from its base 36 a plurality of carousel wall members 38 extending therefrom which together form the shape of the carousel cylinder. In the embodiment shown, there are six such wall members shown. Between each adjacent pair of wall members 38 are opposing surfaces 40 which are generally arcuate to provide a cylindrical channel within which a generally cylindrical pin may articulate as described more in detail hereinafter. Drive shaft 18 is located on a drive axis 42.

Rear cover 16 is removably attached to the rear of housing 12 and has a hole 44 located on axis 42 so that drive shaft 18 can be inserted through clearance hole 44 and fit into cap 46 of drive hub 20. Rear cover 16 also includes a raised portion 48 having an outer surface 50 which is generally circular to match the inner cam surface of housing 12 to provide a fluid-tight seal. In addition, rear cover 16 includes an inner raised surface 52 in which the rear surface 54 of carousel 34 rides when it is rotatably driven by drive shaft 18. Raised portion 48 includes a pair of curved triangular wedge-shaped fluid escape channels 101 and 102. Each channel 101 and 102 has a base depression 104 and 106, respectively, which forms the deepest part of the channel. Each channel 101 and 102 has an inclined bottom surface and walls which gets progressively more shallow and narrow from base depression 104 and 106 until reaching apex 108 and 110, respectively, at which point each channel 101 and 102 is flush with flat raised portion 48. The fluid escape channels 101 and 102 are oriented symmetrically and point in a generally upward direction, and serve to minimize unwanted fluid pressure build-up in the pump as further explained below.

Referring now to FIG. 3, there are shown additional components comprising the present invention. A plurality of vanes 60 are equally spaced and arranged substantially radially about central axis 32. Each vane 60 is in the embodiment shown a paddle or other impeller blade which is used to move the fluid through the pump. Each vane 60 is a flat blade having a distal end 62 which is shaped to conform to the shape of the inner cam surface 30 of housing 12. In the embodiment shown, distal end 62 is flat to conform to the flat inner cam surface 30 to provide a sufficient fluid-tight seal yet allow movement of distal end 62 along cam surface 32 allowing efficient operation of the pump 10. At proximate end 64 of vane 60, is a cylindrical pivot portion 66. Cylindrical pivot portion 66 runs the entire transverse width of vane 60 and is integral therewith to provide sturdy support for vane 60.

Each vane 60 is pivotally coupled to a freely rotating central rotor gear 70. Since central rotor gear 70 has a series of equally spaced longitudinal grooves 72 arranged about its circumference which are cylindrical and have a diameter slightly larger than that of cylindrical pivot portion 66 to enable vane 60 to pivotally articulate within the rotor gear 70 and provide an articulating seat for each rotor. In the embodiment shown, there are six vanes and the central rotor gear or spider gear 70 has six grooves for pivotally coupling each of said vanes thereto. As shown, each vane 60 then is pivotally connected about an axis 68 within each of the slots 72.

Spider gear 70 has a longitudinal mounting hole 74 of a diameter such that it is freely rotatable and mounted on a mounting pin 76 along central axis 32. Mounting pin 76 is connected in perpendicular fashion to front cover 80. Similar to rear cover 16, front cover 80 has a raised portion 82 having an outer sealing surface 84 for providing sealing engagement with housing 12. Raised portion 82 includes a pair of curved wedge shaped inclined fluid escape channels 112 and 114, which have a shape and symmetrical location on raised portion 82 corresponding to channels 101 and 102 on raised portion 48 of rear cover 16. Also channels 101 and 102 are positioned to be laterally opposite and in parallel orientation with channels 112 and 114, respectively, when the pump 10 is assembled. Channels 112 and 114 each have a base portion 118 and 120, and become progressively shallower from base portions 118 and 120 to each apex 122 and 124, respectively, at which point each channel is flush with the surface of raised portion 82. In addition, raised portion 82 has an inner race surface 86 in which front surface 56 of each of the wall members 38 of carousel 34 ride upon rotation of carousel 34. Front cover 80 also includes a central raised flat circular portion 116. Central portion 116 has a circumference surface 118, concentric with inner race surface 86, to from a groove in which carousel 34 is guided during its rotation. Central portion 116 includes a pair of fluid escape channels 126 and 128 symmetrically located thereon. Channels 126 and 128 are smaller than channels 112 and 114, but are similarly formed, except that they are inverted, with the apex of channel 126 and 128 each pointing in a generally downward direction.

Further with reference to FIG. 3, there is shown for each vane 60 a cylindrical Fin 88 having a slot 90 which passes through pin 88. Each slot. 90 is of sufficient size so that vane 60 can pass in a clearance fashion through the pin 90 and allow the vane 60 to reciprocate back and forth through each pin 90. The diameter of each pin 90 is sized to movably fit within the opening 92 formed by the opposing arcuate surfaces 40 of each pair of adjacent wall members 38 in carousel 34 as shown in FIG. 4. Thus pin 88 can rotate within opening 92 and at the same time vane 60 can reciprocate through slot 90 in pin 88 to provide reciprocating and rocking action simultaneously during operation of the pump. As shown in FIG. 4, the vanes 56, 57, 58, 59, 60, and 61 are carried in gear 70 and carousel 34 so that during rotation of carousel 34, a pair of vanes (e.g., 59 and 61) move through a horizontal position in which they are parallel to flow axis 1102. In this position, alternating vanes are paired and lie on a line which is slightly offset from central vane axis 32. However, when vanes are moved to a position perpendicular or vertical position (e.g., vanes 57 and 60), the vanes are paired and lie on a line which passes through the central vane axis 32. As a result, the distance between the ends of the vanes in the horizontal position, e.g., vanes 59 and 61, is slightly less than the distance between the ends of the vanes when moved to the vertical or perpendicular position, e.g., vanes 57 and 60. Thus, the path of travel of the ends of the vanes as they rotate is not exactly that of a circle but is slightly elliptical. Therefore, as mentioned earlier, cam surface 30 is slightly elliptical with the horizontal width "h" being slightly less than the vertical distance or height "v". In a preferred embodiment, with a cam diameter of about eight inches, width h is about five thousandths of an inch less than height v, or substantially in the range from 0.05 to 0.07 percent less than the height, preferable about 0.0625 percent less. This improves fluid flow performance and efficiency of the pump.

Moreover, by orienting the vanes in this offset manner, it can also be seen that when vanes 59 and 61 are in the horizontal position, the lower vane 60 is at a maximum distance of separation from adjacent vanes 59 and 61, to thereby maximize intake and output volume and thus fluid flow during the pumping phase of the cycle. Upper vanes 56, 57, and 58 are at a lesser distance of separation from one another, but this does not detract from performance since they are not then involved in the pumping phase of the cycle.

In the embodiment shown, each vane 60 is approximately 2¾ inches wide, and 3½ inches long. The diameter of the inner cam surface 30 of the housing 12 is about 8 inches. The carousel rotor 34 is about 6 inches in diameter. There are six vanes 60. The carousel drive axis 42 is located one inch above the central vane axis 32. The rotor gear 70 is of sufficient size to offset the axis of cylindrical pivot portion 66 of the proximate end 64 of vane 60 about one half inch from central vane axis 32.

Figure 5:
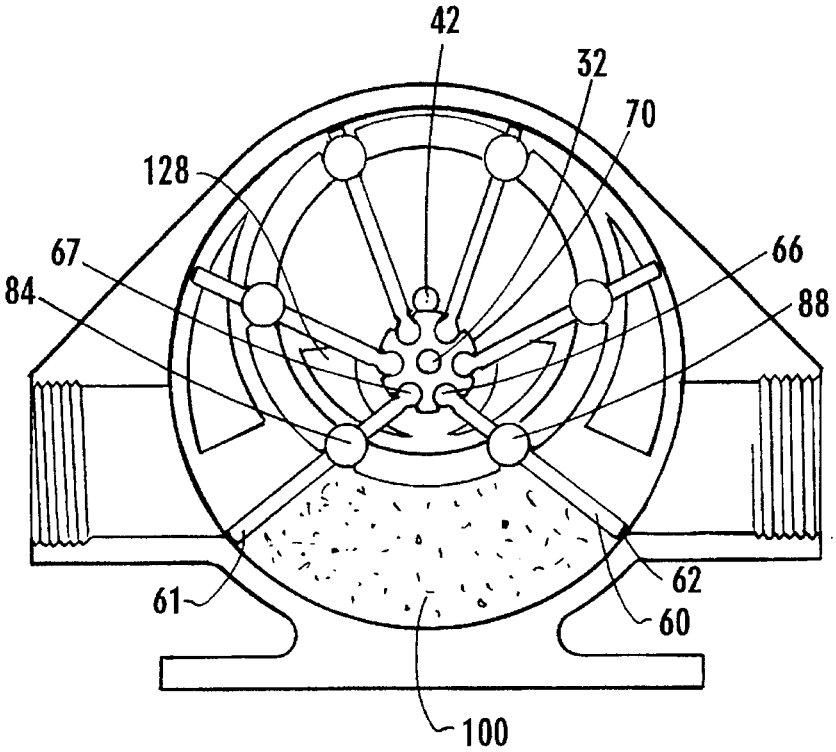
FIG. 5 is a view similar to FIG. 4, except that the pump is shown rotated to a transitional stage of operation.
Figure 6:
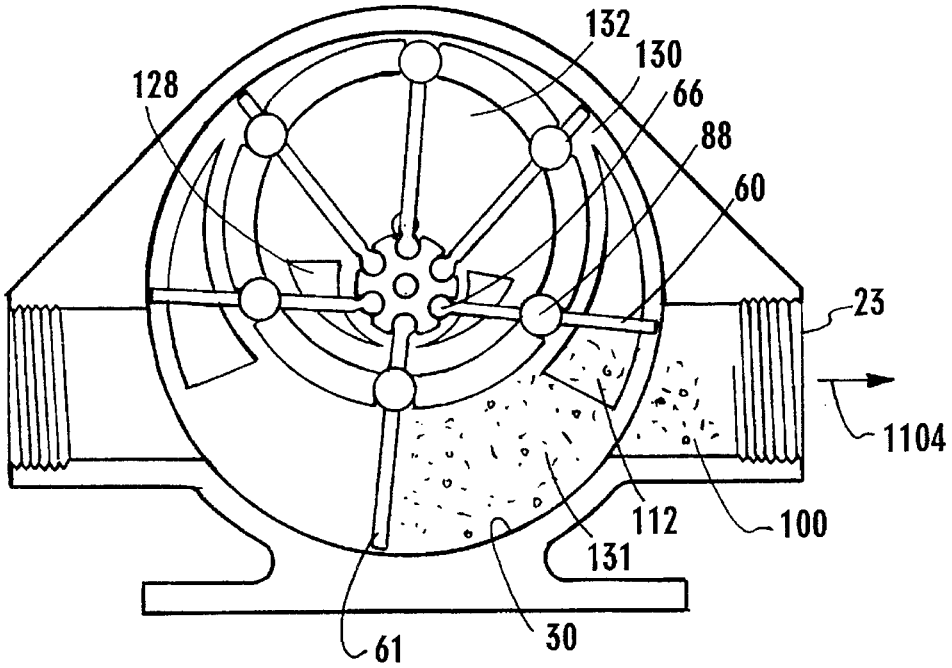
FIG. 6 is a view similar to FIG. 5, except that the pump is shown rotated to an output phase of operation.

Operation of the pump can perhaps best be understood with reference to FIGS. 4 through 6 in which a portion of a cycle of the pump is illustrated. In particular, referring now to FIG. 4 the pump is shown during an input phase of operation. In particular, liquid 100 is introduced generally in the direction of input input arrow or flow axis 1104 into inlet port 22 of pump 10. In FIG. 4 it can be seen that in this portion of the intake portion of the cycle, that adjacent vanes 60 and 61 are positioned to allow a volume of liquid defined by the walls of the inner cam surface 30, the carousel wall member 38, the inner surfaces of front and rear covers 14 and 16, and the surfaces of vanes 60 and 61. This defines a chamber through which the liquid 100 is pumped. Vane 61 passes through pin 89 and vane 60 passes through pin 88. As drive shaft 18 turns carousel 34 generally in a counter clockwise direction, it can be seen that vanes 60 and 61 move to the position shown in FIG. 5. The volume of liquid 100 is then contained within the chamber as defined by the inner portion of the housing and the vanes as described above. It is important to note at this position that there has been an increased volume of fluid and increased rate of movement of the vanes through this portion of the cycle, more so than in conventional pumps.

Since the pivot portion 66 of each vane is pivotally seated in groove 72 of gear 70 having its center of axis of rotation at central axis 32, rotation of carousel 34 causes by virtue of pins 88 the rotation of gear 70 to provide a rocking action. It can be seen that the vanes 60 are pivoted off center and thus give rise to an increased movement of the distal end 62 of each vane. In conventional rotary vane pumps, the angle of sweep of each vane has been shown less than that permitted by the construction of the presently claimed invention. There is a significant improvement of the efficiency of the pump due to the arrangement of the components as herein described. This also results in increased volumes of fluid moving through the pump during operation thereof. In operation, fluid escape channels 101, 102 and 118, 120 allow any extra fluid which is not expelled through outlet port 23, and which would otherwise become trapped in upper chamber area 130, to escape in a controlled manner from area 130 back into pumping chamber area 131 for expulsion. In this manner, fluid will not be trapped in upper area 130 as the carousel rotates, which would create unwanted pressure and resistance to efficient operation of the pump 10. Due to the shape and location of the fluid escape channels 101,102 and 112,114, the return fluid flow resistance is minimized without degrading the performance of the pump 10. In addition, any fluid which may be present within area 132 inside carousel rotor 34, is carried out through channels 126 and 128.

Further with reference to FIG. 6, as the pump is further rotated to the position shown so that the liquid 100 is moved to the outlet port 23 of the pump and ejected generally in the direction of output arrow 1104. As seen in FIG. 6, the vane 60 has reciprocated through rotatable pin 88 to maintain the appropriate amount of clearance required with inner cam surface 30 to move to a position to allow release of the liquid 100. Thus, the improved efficiency of the present invention can be appreciated, and the benefits can be attained with respect to its use.

Although not shown, there can be various shapes of vanes and the appropriate amount of fluid can also escape through the slot 90 in each pin 88 to assure that the liquid can be moved through the pump efficiently. Typically, liquid such as water cannot be compressed, so it is important that compression of the fluid not occur and appropriate pressure release points be included, such as through the clearances allowed in the slot 90 of pin 88, and in the clearance between the pin 88 and the opening 92, to assimilate the appropriate amount of pressure release. If additional pressure release is required according to the design being used, appropriate pressure release orifices or channels can be incorporated therein.

While the particular rotary vane pump apparatus as herein shown and disclosed in detail is fully capable of obtaining the objects and providing the advantages hereinbefore stated, it is to be understood it is merely illustrative of the presently preferred embodiments of the invention and that no limitations are intended to the details of construction or design herein shown other than as defined in the appended claims.

I claim:

1. A rotary vane pump, comprising:

(a) a housing having an inner cam surface defining a chamber, said housing having an inlet and an outlet for establishing fluid communication with said chamber;

(b) a plurality of vanes arranged substantially about a central vane axis of rotation, each said vane having an edge for following said cam surface;

(c) a rotatable carousel rotor positioned in said chamber for driving movement of said vanes, said carousel having a drive axis of rotation displaced a predetermined distance from said central vane axis, said carousel having spaced slot members positioned therein for reciprocally carrying said vanes during rotation of said vanes;

(d) a central rotor means rotatably mounted in said housing on said central vane axis, said central rotor means including a one-piece member for pivotally coupling each said vane thereto at a point offset from said vane axis to establish rocking lever action between said carousel and said vanes upon rotation of said vanes by said carousel;

(e) said inlet and outlet being located opposite and in line with one another along a flow axis;

(f) said housing having an inner surface including at least one inclined fluid escape channel for directing fluid out of an upper portion of said chamber to a lower portion of said chamber for expulsion during rotation of said vanes; and, (g) each said vane being carried in said central rotor means and carousel rotor so that during rotation of said carousel a pair of said vanes move through a position in which said pair of vanes are situated on a line offset from said central vane axis and parallel to said flow axis.

2. The apparatus of claim 1, wherein said coupling means comprises each said vane being hingedly connected to said rotor means along substantially the entire transverse width of said vane.

3. The apparatus of claim 1, wherein said central rotor means comprises a spider gear having a plurality of equally spaced grooves and each of said vanes includes a cylindrical pivot portion pivotally coupled in each said groove.

4. The apparatus of claim 1, wherein said carousel walls form equally spaced openings and further including a slotted pin rotatably disposed in each said opening for reciprocally receiving each said vane.

5. The apparatus of claim 1, wherein there are six vanes.

6. A rotary vane pump, comprising:

(a) a housing having an inner cam surface defining a chamber, said housing having an inlet and an outlet For establishing fluid communication with said chamber;

(b) a plurality of vanes arranged substantially about a central vane axis of rotation, each said vane having an edge for following said cam surface;

(c) a rotatable carousel rotor positioned in said chamber for driving movement of said vanes, said carousel having a drive axis of rotation displaced a predetermined distance from said central vane axis said carousel having spaced slot members positioned therein for reciprocally carrying said vanes during rotation of said vanes:

(d) a central rotor means rotatably mounted in said housing on said central vane axis, said central rotor means including a one-piece member for pivotally coupling each said vane thereto at a point offset from said vane axis to establish rocking lever action between said carousel and said vanes upon rotation of said vanes by said carousel;

(e) said inlet and outlet being located opposite and in line with one another; and (f) each said vane being carried in said central rotor means and carousel rotor so that during rotation of said carousel a first pair of said vanes move through a first position in which said first pair of vanes are situated on a line offset from said central vane axis and parallel to said flow axis.

7. The apparatus of claim 6, wherein each said vane is carried in said central rotor means and carousel so that a second pair of said vanes move through a position perpendicular to said first position in which said pair of vanes are situated on a line which passes through said central vane axis.

8. The apparatus of claim 7, wherein said inner cam surface is elliptical, having its width as measured in a direction parallel to said flow axis being less than its height as measured in a direction perpendicular to said flow axis.

9. The apparatus of claim 8, wherein said width is substantially in the range of from 0.05 to 0.07 percent less than said height.

* * * * *